US005821504A

United States Patent [19]

Sprenger et al.

[11] Patent Number: 5,821,504

[45] Date of Patent: Oct. 13, 1998

[54] INDUCTION HEATING SYSTEM FOR 360° CURING OF CAN BODY COATINGS

[75] Inventors: Barbara Sprenger, Felton, Calif.; Mark Gacka, Lakewood, Ohio; Robert A. Sprenger, deceased, late of Felton, Calif., by Barbara Sprenger legal representative

[73] Assignee: Nordson Corporation, Westlake, Ohio

[21] Appl. No.: 838,408

[22] Filed: Apr. 7, 1997

Related U.S. Application Data

[63] Continuation of Ser. No. 438,881, May 10, 1995, which is a continuation-in-part of Ser. No. 832,987, Feb. 10, 1992, abandoned, which is a continuation-in-part of Ser. No. 621,231, Nov. 30, 1990, abandoned, which is a continuation-in-part of Ser. No. 532,945, Jun. 4, 1990, abandoned, and Ser. No. 425,995, Apr. 20, 1995, abandoned.

[51] Int. Cl.[6] ..... H05B 6/10

[52] U.S. Cl. ..... 219/635; 219/604; 219/609; 219/653

[58] Field of Search ..... 219/604, 609, 219/635, 645, 647, 650, 653, 672; 34/247

[56] References Cited

U.S. PATENT DOCUMENTS

| | | | |
|---|---|---|---|
| 3,290,476 | 12/1966 | Scheffler | 219/10.69 |
| 3,526,027 | 9/1970 | Manuel et al. | 29/200 |
| 3,694,609 | 9/1972 | Kennedy | 219/10.79 |
| 3,794,802 | 2/1974 | Mohr | 219/10.79 |
| 3,840,138 | 10/1974 | Mohr | 219/10.57 |
| 3,961,150 | 6/1976 | Lewis et al. . | |
| 4,017,704 | 4/1977 | Collins et al. | 219/10.79 |
| 4,268,737 | 5/1981 | Paschakarnis et al. . | |
| 4,333,246 | 6/1982 | Sullivan et al. | 34/23 |
| 4,456,804 | 6/1984 | Lasky et al. . | |
| 4,539,456 | 9/1985 | Mohr | 219/10.43 |
| 4,595,607 | 6/1986 | Betteridge et al. | 427/185 |
| 4,596,913 | 6/1986 | Takechi et al. | 219/8.5 |
| 4,754,113 | 6/1988 | Mohr et al. | 219/10.79 |
| 4,759,946 | 7/1988 | Ribnitz | 427/8 |
| 5,321,896 | 6/1994 | Brownewell et al. | 34/247 |

FOREIGN PATENT DOCUMENTS

| | | |
|---|---|---|
| 0 426 258 A1 | 5/1991 | European Pat. Off. . |
| 1 039 672 | 9/1958 | Germany . |
| 56030048 | 3/1981 | Japan . |
| 2111815 | 4/1990 | Japan . |
| 2 118 051 | 10/1983 | United Kingdom . |
| 92/09397 | 6/1992 | WIPO . |
| 93/16570 | 8/1993 | WIPO . |
| 93/24242 | 12/1993 | WIPO . |
| 94/13118 | 6/1994 | WIPO . |

OTHER PUBLICATIONS

Integrating Research, Industry and Education in Energy and Communication Engineering, pp. 43–46 entitled "Medium Frequency Self Controlled Converter for Induction Heating Applications".

"Medium Frequency Induction Melting—Its Control and Effective Operation" by Peter A. Hassell, pp. 18–21 of Mar., 1982 issue of Industrial Heating.

"General Considerations for the Choice of Medium Frequency for Induction Melting," by P.A. James pp. B138–B146.

"Coil Design and Fabrication: Basic Design and Modifications," by Stanley Zinn and S.L. Semiatin, pp. 32–36 of Jun., 1988 issue of Heat Treating.

(List continued on next page.)

*Primary Examiner*—Tu B. Hoang
*Attorney, Agent, or Firm*—Fliesler, Dubb, Meyer & Lovejoy LLP

[57] ABSTRACT

A method and apparatus for 360° induction heating of a can body to cure or partially cure a protective coating applied thereto. The can bodies are inductively heated by placing them in a medium frequency, oscillating magnetic field generated by a multiple turn induction coil helically wound around the transport path of the can body. By using a medium-frequency field and by centering the can bodies with respect to the induction coil, the can bodies may be evenly and uniformly heated around 360° of their circumference.

46 Claims, 7 Drawing Sheets

OTHER PUBLICATIONS

"Coil Design and Fabrication: Part 2, Specialty Coils," by Stanley Zinn and S.L. Semiatin, pp. 29–32 of Aug., 1988 issue of Heat Treating.

"Coil Design and Fabrication, Part 3: Fabrication Principles," by Stanley Zinn and S.L. Semiatin, pp. 39–41 of Oct., 1988 issue of Heat Treating.

"Atomic Energy Technology Applied in Liquid Metal Processing,"by T. Smith, p. 174 of Apr., 1990 issue of Metallurgia.

"Elements of Induction Heating: Design, Control, and Applications" by S. Zinn and S.L. Semiatin.

INDUCTION HEATING SYSTEM FOR 360° CURING OF CAN BODY COATINGS

This application is a continuation of Ser. No. 08/438,881, filed May 10, 1995, now abandoned; which is a continuation-in-part of Ser. No. 07/832,987, filed Feb. 10, 1992; now abandoned which is a continuation-in-part of Ser. No. 07/621,231, filed Nov. 30, 1990, now abandoned; which is a continuation-in-part of Ser. No. 07/532,945, filed Jun. 4, 1990, now abandoned; and a continuation-in-part of Ser. No. 08/425,995, filed Apr. 20, 1995.

BACKGROUND OF THE INVENTION

1. Field of the Invention

The present invention relates to a method and apparatus for heating or otherwise treating metal objects, and more particularly, to a method and apparatus for inductively heating metal can bodies for drying, partially curing or curing a coating thereon, and for transporting the can bodies through the induction heating apparatus.

2. Description of Related Art

The process of manufacturing 3-piece metal cans for the storage of food and perishable items typically involves forming a cylindrical can body from a sheet of pre-coated metal and then attaching two pre-coated lids to the opposite ends of the can body. The pre-coat protects the contents of can against contamination and prevents corrosion of the metal can by the can contents. After the can body is formed into a cylinder, the edges of the sheet are welded together along the seam. The welding process damages the protective pre-coat around the seam, thereby necessitating application of a side stripe of protective coating at least in the area of the seam.

It is known to apply a protective coat around 360° of the circumference of the can body during the can fabrication process after the seam has been welded. This may be done instead of using pre-coated can stock, or in addition to the pre-coated can stock where an extra layer of protective coating is desired. Application of a 360° coating after the seam has been welded further may allow the step of applying the protective side stripe to the welded seam to be omitted. Such a protective coating may be applied to the can body in the form of a powder resin or as a solvent-based liquid. After the protective coating has been applied to the can body, the coating is cured onto the can body through a heating process which is generally a function of both heating and time.

As the protective coating applied around the circumference of the can body may detach before it is cured, it is important that the coating be heated as soon as possible after its application to adhere the coating to the can body. It is also important that a can body is evenly heated to ensure that all portions of the coating are fully cured without overheating any one section. Heating a can body too little may result in insufficient curing of the coating thereon, and heating a can body too much may cause blistering of the coating and possibly a reflowing of the metal from which the can is formed. Blistering of the coating results in an uneven and poorly finished protective coat.

In conventional can fabrication assembly lines, a can body is typically transported from the coating process to a heating oven to cure the coatings generally by convection air flow. Such systems tend to be large and bulky, requiring a large amount of space within the fabrication site. Moreover, much of the heat generated by such ovens is absorbed into the walls and air within the heating chamber, and only a small portion of the heat generated, in most cases about 20%, actually heats the can bodies. Therefore, such systems are inefficient and expensive to operate.

Can bodies typically leave the coating process in single file. In order to increase the throughput of the fabrication process, the can bodies are taken from their single file and lined up generally ten to twenty cans across for entry into the curing oven. After the heating process, the can bodies are again realigned in single file. Such a procedure has two-fold disadvantages. First, equipment and extra processing steps are necessary both to line up and realign the can bodies before and after the heating process. This adds to the time and cost of the fabrication process. Second, the can bodies must be handled to align them in rows prior to curing of the protective coating, which handling may result in loss of or damage to the protective coating.

A further problem associated with convection heating to cure, in particular, liquid coatings is that such conventional heating mechanisms heat from the outside of the coating inward. Thus, the outer surface of the coating tends to form a skin, and the liquid underneath gets trapped and blisters in trying to break through the outer skin.

Another problem arises in conventional convection ovens if the can bodies remain within the heating chamber for a longer period of time than intended, as for example when the conveyor system for the can bodies breaks down. In this situation, even if the convection oven is turned off, heat within the oven continues to heat the can bodies, and the can bodies may be overheated and potentially destroyed.

Induction heaters are known for heating electrically conductive workpieces. Induction heating fundamentally involves passing an oscillating current through an induction coil to create an oscillating magnetic field in which the electrically conductive workpiece is placed. Heat is produced in the workpiece due to eddy current losses resulting from circulating currents induced in the workpiece by the field. It is significant that the amount of heat produced within a workpiece is directly related to the separation distance between the workpiece and the induction coil. Where other system parameters remain constant, the smaller the separation distance between the workpiece and the induction coil, the greater the amount of heat generated within the can body.

Prior art induction heating systems have typically operated at high frequencies on the order of 100 kHz to 250 kHz. High frequencies tend to minimize the depth to which currents are generated beneath the surface of a workpiece (the "skin effect"). Consequently, the heat generated within a workpiece by high frequency currents is concentrated near the surface of the workpiece.

Operation at high frequencies has several disadvantages with respect to heating of can bodies. The first disadvantage relates to heating uniformity within the can body. Factors such as deformities in a workpiece and unintended movement of the workpiece with respect to the conveyor path cause a variation in the separation distance between the workpiece and the induction coil, which as stated above will vary the amount of heat generated within the workpiece. A problem with high frequency currents is that such currents intensify this heating non-uniformity because of the high heat concentration near the surface of the workpiece. As such, different portions of a workpiece may be heated to greatly varying degrees depending on the proximity to the coil and other factors. Consequently, localized overheating can easily and frequently does occur, even before other parts of the workpiece are heated to a desired temperature.

Moreover, high frequency currents also stay near the surface of the electrical conductors carrying the current to and in the induction coil, thereby causing excessive heating of the electrical conductors. As such, water cooling systems have been necessary to adequately cool the conductors. Typically, these conductors were constructed using copper tubing with water flowing through the center.

Induction heating methods and apparatus in general, although not necessarily addressing the special problems of can bodies are shown in the following U.S. Patents: U.S. Pat. No. 4,339,645 to Miller, U.S. Pat. No. 4,481,397 to Maurice, U.S. Pat. No. 4,296,294 to Beckert, U.S. Pat. No. 4,849,598 to Nozaki, U.S. Pat. No. 4,160,891 to Scheffler, U.S. Pat. No. 3,449,539 to Scheffler, U.S. Pat. No. 4,307,276 to Kurata, U.S. Pat. No. 4,582,972 to Curtin, U.S. Pat. No. 4,673,781 to Nuns, U.S. Pat. No. 4,531,037 to Camus, U.S. Pat. No. 4,775,772 to Chaboseau, U.S. Pat. No. 4,810,843 to Wicker, and U.S. Pat. No. 3,727,982 to Itoh.

Conventional induction heating systems are known for welding a can body seam, such as for example that disclosed in U.S. Pat. No. 4,783,233 to Yasumuro. Induction heat welding does not present many of the problems presented by induction heat drying and curing, and several important distinctions exist between the two processes. For example, welding processes need not be concerned with heating a workpiece too quickly. As long as a sufficient amount of heat is generated within the workpiece for a controlled period of time, the weld will be properly formed. However, in a curing process, if the workpiece is heated too quickly, blistering of a liquid coating may occur (as described above) and a powder may cure before it is able to evenly flow around the surface of the can body.

Another important distinction between welding and curing around 360° of a can body is that induction heat welding presents a one dimension positioning problem. That is, as shown in cross section view of FIG. 1, at a given moment during the welding process, an induction heater is heating what amounts to a single point along the seam passing thereunder, indicated at arrow A on the workpiece. As indicated above, the amount of heat generated within a workpiece is directly related to the distance between the workpiece and the induction heating element. Therefore, in order to control the amount of heat generated at a point on the weld seam, it is only necessary to control the position of the induction heater with respect to that one point.

By contrast, induction curing around 360° of a cylindrical workpiece such as a can body presents a two dimension positioning problem. That is, as shown in the cross section view of FIG. 2, at a given moment during the curing process, the induction heater must heat all points around the circumference of the workpiece, indicated by arrows $B_1, B_2, \ldots B_i$. Thus, in order to control the amount of heat generated at each point around the circumference, it is necessary to control the position of the induction heater with respect to each such point. Applicants are unaware of any conventional systems for accomplishing curing around 360° of a can body.

SUMMARY OF THE INVENTION

Accordingly, it is an object of the present invention to provide a 360° can body heating method and apparatus which overcomes some or all of the above disadvantages.

The invention in general relates to 360° induction heating of a can body to heat, dry, cure and/or partially cure a protective coating applied thereto. The can bodies are inductively heated by placing them in a medium frequency (500 Hz to 50 kHz), oscillating magnetic field preferably generated by a multiple turn induction coil helically wound around the transport path of the can body. By using a medium-frequency field and by centering the can bodies with respect to the induction coil, the can bodies may be evenly and uniformly heated around 360° of their circumference.

Can bodies are conveyed lengthwise, end-to-end, through the induction heating apparatus on a conveyor which receives the can bodies from the protective coating process. The can bodies and conveyor pass through the induction heating apparatus within a non-conductive isolation tube. The isolation tube isolates the can bodies from the induction heating apparatus so that circulating air within the apparatus does not blow off the coating within the can bodies, and any coating which does become dislodged from the can bodies is maintained within the tube and does not fall onto the induction coil, electrical components or apparatus interior.

The induction coil is helically wound around the entire length of the isolation tube so that a magnetic field is set up within the isolation tube to heat the can bodies. The diameter of the isolation tube is only slightly larger than the diameter of a can so that the can bodies travel through the heater in a relatively fixed and centered position with respect to the isolation tube and induction coil. As such, the can bodies are uniformly heated around their entire circumference.

As indicated above, an air circulation system may be provided within the heating apparatus to cool the induction coil. As medium frequency currents are used, the current travels more deeply within the conductors leading to and within the inductive coil, and as such, the electrical conductors do not become excessively hot. Therefore, the electrical components and the induction coil may be cooled by a relatively simple and inexpensive convection air flow system.

A further result of using medium frequency currents is that the conventional centrally water cooled tubing may be replaced by smaller diameter wire within the coil. Such a coil offers advantages relative to conventional copper tubing that it is less expensive to use and also a larger number of turns or loops may be wrapped around a given length of the isolation tube if desired, thereby further reducing current flow requirements.

Temperature sensors may be provided within the isolation tube for monitoring the temperature of the can bodies passing therethrough to enable a shut down of the power supply if the temperature exceeds a predetermined threshold.

After leaving the apparatus, the conveyor system carries the cured or partially cured can bodies to an adjacent processing station or another conveyor system.

BRIEF DESCRIPTION OF THE DRAWINGS

The invention will be described with respect to particular embodiments thereof, and reference will be made to the drawings, in which.

DETAILED DESCRIPTION

The invention will now be described with reference to FIGS. 1 through 9, which in general relate to an induction heater and conveyor system for curing or partially curing protective coatings onto can bodies during the can fabrication process. While the present invention is described in the context of a manufacture of a can for food or other such perishable items, it is understood that the present invention may be used in a wide variety of applications where it is desired to cure or otherwise evenly heat around 360° of a cylindrical workpiece. Moreover, although the invention is described with respect to ferromagnetic steel can bodies, it is understood that the present invention may be used to heat other electrically conductive workpieces such as aluminum can bodies.

As indicated in the Background of the Invention section, it is desirable to coat 360° of a cylindrical can body with a coating typically comprised of a dry resin powder or a solvent-based liquid. A method and apparatus for applying such a protective coating is disclosed in U.S. Pat. application Ser. No. 08/393,150, entitled "Method And Apparatus For Powder Coating Welded Cans", which application is owned by assignee of the present invention and is hereby incorporated by reference. As disclosed in that Application, a protective powder coating is electrostatically charged during the coating process to attract and attach the powder coating particles to the interior of a can body, which can body is electrically grounded. The protective coating must thereafter be cured onto the can body. According to the present invention, an induction heating system is used to heat the can bodies to dry, fuse, cure and/or partially cure the protective coating onto the can bodies.

In a preferred embodiment, the protective coating may be completely cured within the induction heating apparatus of the present invention, thereby omitting the need for a conventional convection oven. However, it is understood that the induction heating apparatus according to the present invention may be used in addition to a conventional convection oven, whereby the induction heating apparatus partially cures the protective coating in a process taking place either before ("pre-curing") or after ("post-curing") heating of the can bodies within the convection oven. As line speeds have increased and coatings have changed over the years, existing ovens may provide only a marginal cure. Therefore, curing quality can be improved by a pre-curing or post-curing process according to the present invention. Moreover, by partially curing or pre-heating the protective coating immediately after the coating is applied, the can bodies need not be handled with as much care and the line speed may be increased between the coating application station and the conventional convection oven.

Figure 1:
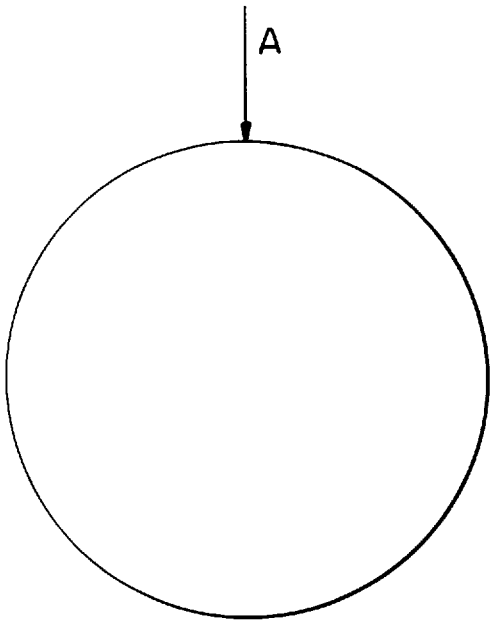
FIG. 1 illustrates the one-dimensional positioning requirements of induction heating of a weld seam.
Figure 2:
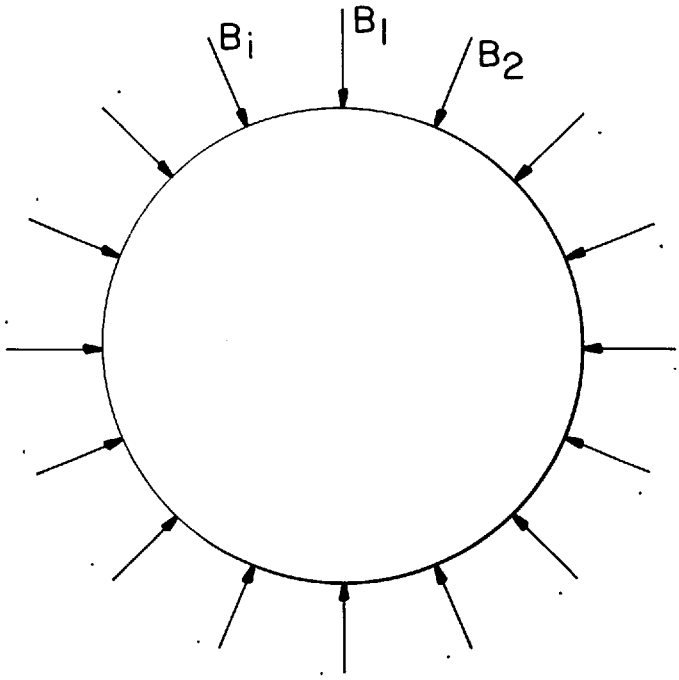
FIG. 2 illustrates the two-dimensional positioning requirements of induction heating of a cylindrical body.
Figure 3:
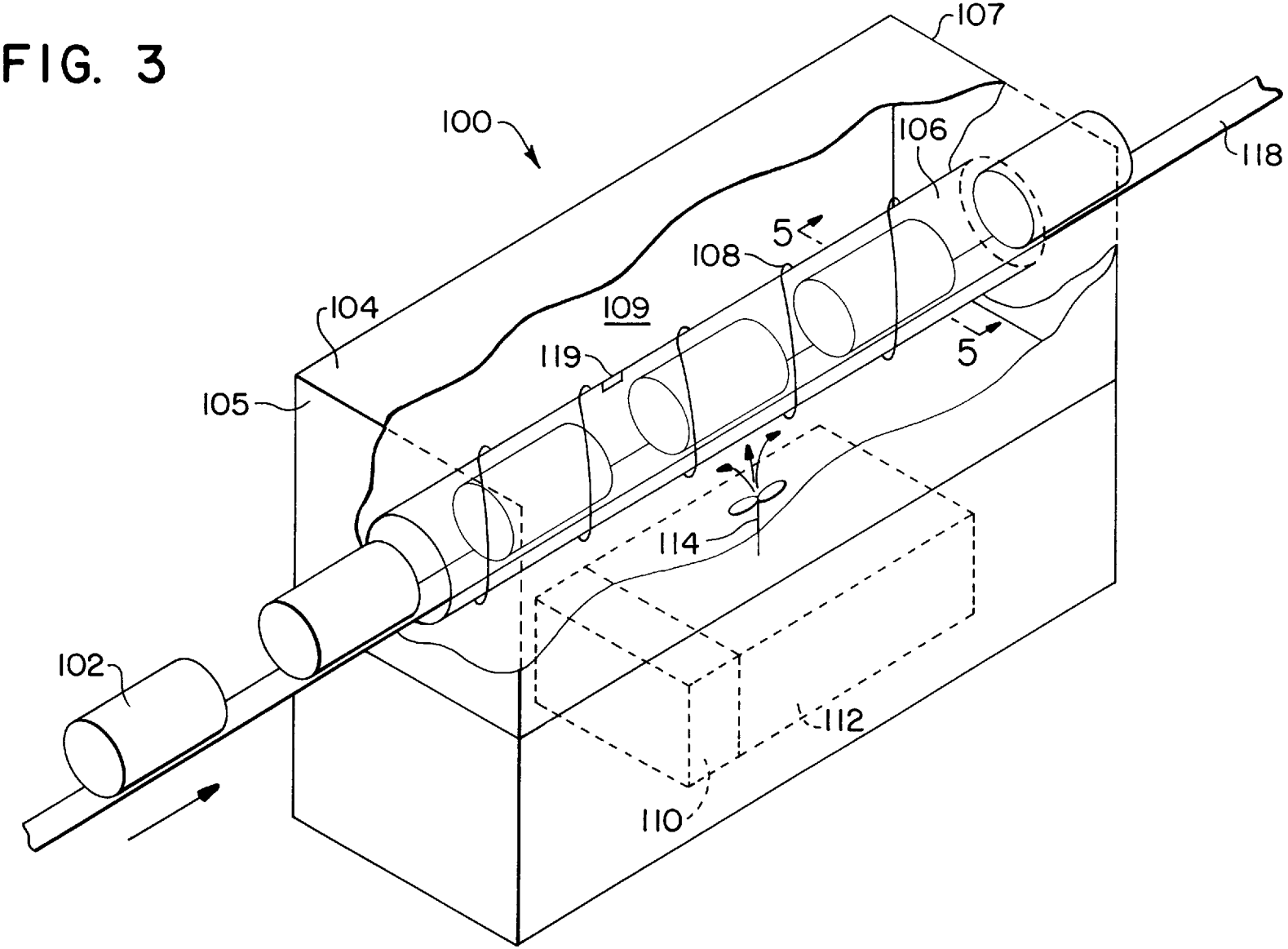
FIG. 3 is a perspective cutaway view of the induction heating apparatus according to the present invention.

Referring now to FIG. 3, there is shown an induction heating apparatus 100 for heating a plurality of can bodies 102. The can bodies enter the heating apparatus at a front end 105 and exit through a rear end 107. A chain 118 is provided for transporting the can bodies 102 through the heating apparatus in longitudinal orientation, i.e., the central axis of a can body cylinder is substantially parallel to the direction of motion of the can body, and the can bodies may abut or nearly abut each other end-to-end. The apparatus 100 includes a housing 104, a portion of which is cut away as shown in FIG. 3 to expose an isolation tube 106 and an induction coil 108 passing through an interior chamber 109 defined by housing 104. (The spacing between turns of the induction coil 108 as shown on FIG. 3 is provided for clarity, and the spacing shown is not to be considered limiting on the present invention). The apparatus 100 further includes a power supply 110, control circuitry 112, and a blower 114 for circulating air throughout chamber 109. The power supply 110, control circuitry 112 and blower 114 are shown symbolically on FIG. 3.

Housing 104 preferably surrounds the induction coil 108 on all six sides of the heating apparatus 100, and preferably comprises a conductive metallic material so as to shield the power supply and control circuitry from, and to provide operator protection against, the medium frequency oscillating currents in the coil 108. As will be explained in greater detail below, the oscillating magnetic field set up by the induction coil 108 is concentrated within tube 106. As such, only minimal heating of housing 104 occurs.

Vents (not shown) may be provided in the top and/or sides of housing 104 to allow circulating air which has been heated by the induction coil 108 to leave the housing. In a preferred embodiment, the heating apparatus 100 has a length, parallel to the direction of can transport, of approximately 13 to 20 feet, a height of approximately 3 feet and a width of approximately 2 feet. As would be appreciated by those skilled in the art, these dimensions may vary in alternative embodiments of the invention. As will be explained in greater detail below, the length of apparatus 100 may be varied depending on the degree to which the can bodies 102 are to be heated and/or the speed with which can bodies 102 are transported through the apparatus 100, i.e., if speed is unchanged, the longer the apparatus 100, the more heat is generated within the can bodies 102 passing therethrough.

The can bodies 102 are transported through the heating apparatus 100 within an isolation tube 106. The tube 106 runs the entire length of the chamber 109 and may be sealed to the housing 104 wall by hubs on both ends of the tube. Thus, can bodies passing through the tube 106 are physically isolated from the chamber 109, such that cooling air circulating within the apparatus does not blow off the coating within the can bodies, and any coating which does become dislodged from the can bodies is maintained within the tube 106 and does not fall onto the heating coil 108 or the chamber interior 109.

It is important in the heating of cylindrical workpieces such as can bodies 102 that the workpieces be substantially concentric with the induction coil during the entire heating process to ensure uniform heating around the circumference of the workpieces. Therefore, isolation tube 106 is preferably provided with a diameter only slightly larger than the diameter of can bodies 102. For example, where can bodies 102 have a diameter of 4¼inches, the inner diameter of tube 106 may be approximately 4¾inches. Thus, the most can bodies 102 may be off center within tube 106 is approximately one-quarter inch. It is understood that the clearance between the can bodies 102 and the tube 106 may be lesser or greater in alternative embodiments. It is advantageous to leave approximately a one-quarter inch clearance between the tube 106 and can bodies 102 for applications where a liquid coating is being cured so that air may be circulated through tube 106 either in the direction of can travel or opposite the direction of can travel. In such an embodiment, the air circulated within the tube 106 may be the heated air from chamber 109 to promote even heating as result of air convection, and also to carry off the solvents evaporated from the protective coating.

Isolation tube 106 is electrically non-conductive so as not to be heated by induction coil 108. Moreover, tube 106 is magnetically non-conductive so as not to interfere with the magnetic field established by induction coil 108. Any of several materials may be used as isolation tube 106, but a preferred material is Pyrex® due to its high heat resistance, transparency so as to allow can viewing, and low cost. Although not critical to the present invention, tube 106 may have a wall thickness of approximately 0.2 to 0.4 inches. Such tubing is available from F.J. Gray Company, Jamaica, N.Y., 11435.

Figure 4:
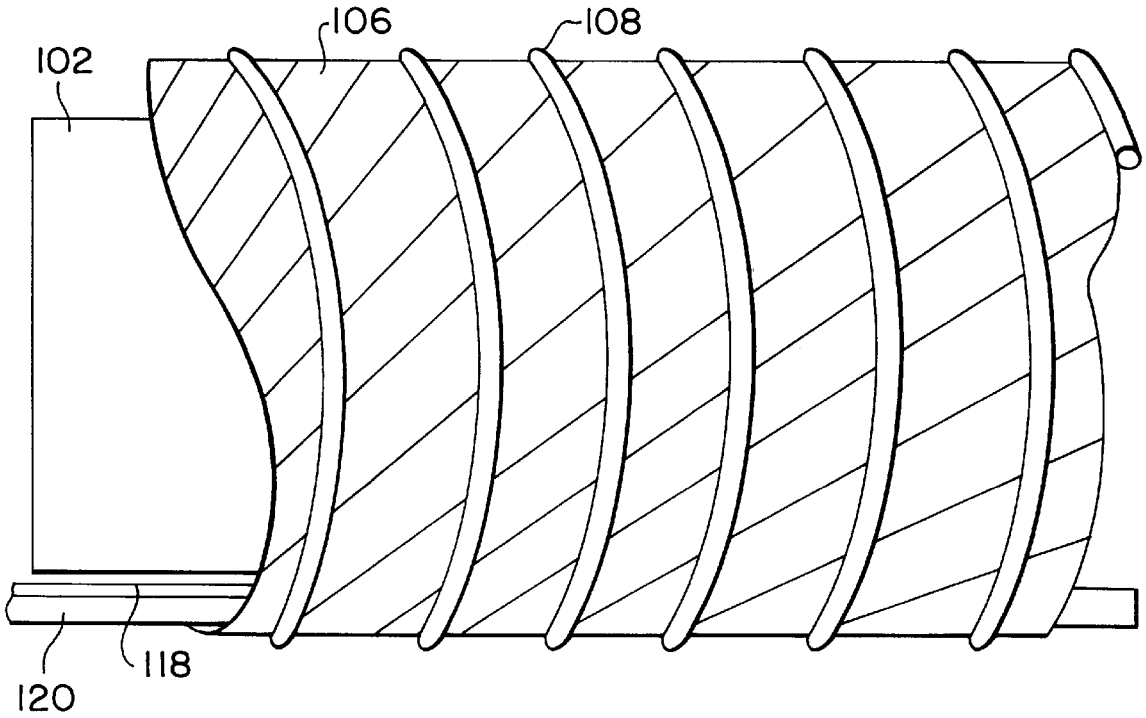
FIG. 4 is an enlarged side view of a section of an isolation tube and induction coil according to the present invention.
Figure 5:
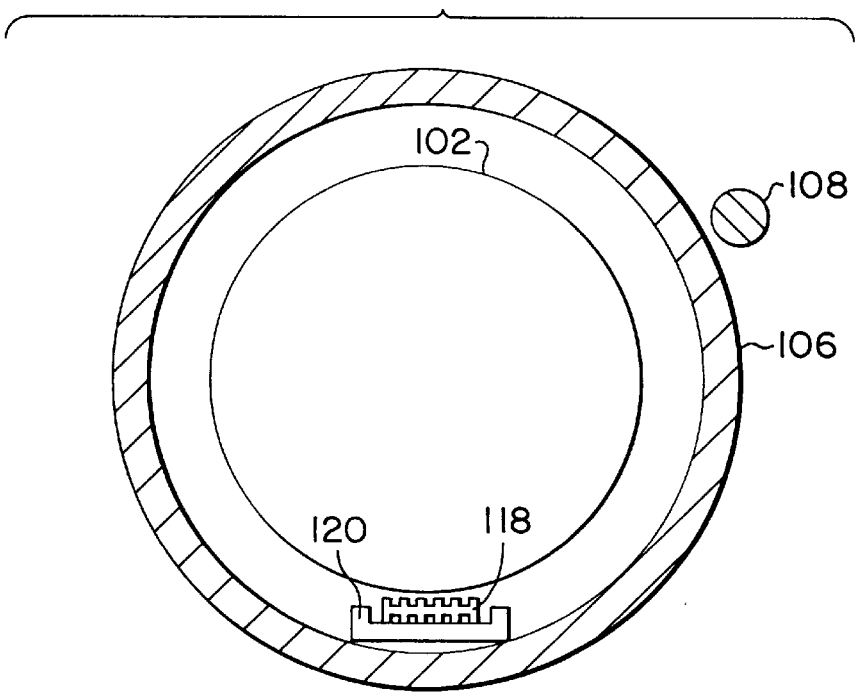
FIG. 5 is a cross-sectional view of a section of an isolation tube and induction coil through line 5—5 on FIG. 3.

As best shown in the side view of FIG. 4 and the cross-sectional view in FIG. 5, can body 102 is supported within tube 106 on a chain 118, which chain is in turn supported within a channel 120 resting on the bottom of the tube 106. Channel 120 is provided so that the chain 118 will not abrade or wear out the bottom of isolation tube 106.

Chain 118 is preferably formed of stainless steel. Although stainless steel is an electrical conductor, the chain 118 does not overheat because the chain is only within the heating apparatus for a portion of its overall travel path (as shown on FIG. 7). Moreover, chain 118 is preferably provided with a cross-sectional diameter on the order of about 0.125 to 0.25 inches, which is small as compared to the cross-sectional area of the induction coil. As would be appreciated by those skilled in the art, where the cross-sectional area of an electrical conductor is small as compared to the crosssectional area of an induction coil, very little heat is coupled within the electrical conductor. Therefore, the chain 118 does not overheat. It is understood that chain 118 may be comprised of other materials in alternative embodiments of the invention. Channel 120 is preferably formed of an electrically non-conductive material, such as for example a ceramic or high molecular density plastic.

Figure 7:
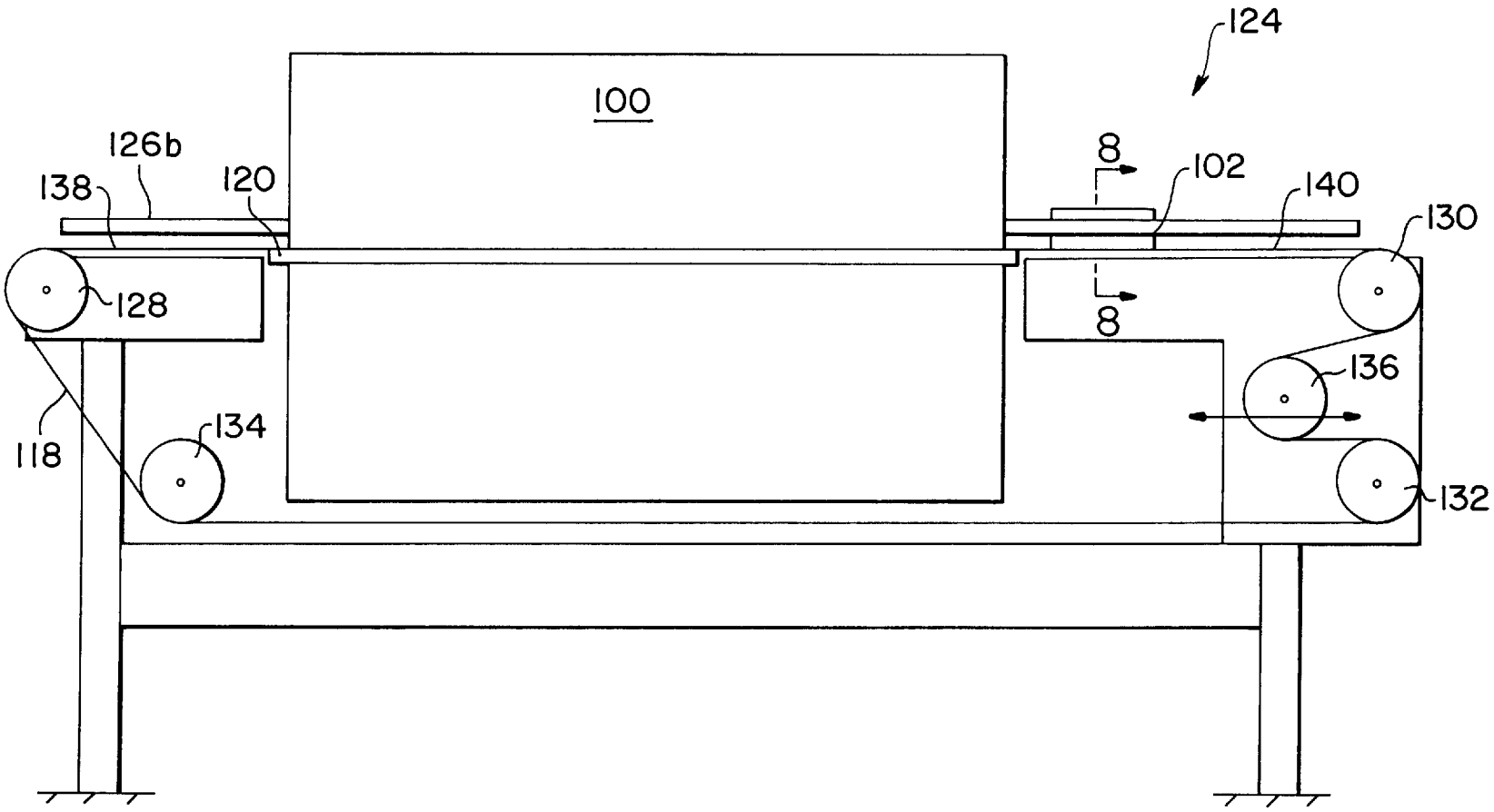
FIG. 7 is a side view of an induction heater and conveyor system according to the present invention.

In a preferred embodiment of the invention, the width of channel 120 is approximately 0.7 inches and the combined height of the chain 118 and channel 120 together is approximately 0.35 inches. However, those skilled in the art will appreciate that these dimensions may vary in alternative embodiments of the present invention. As shown in FIG. 7, channel 120 may extend along the entire upper surface of conveyor system 124.

As stated above, it is important that the can bodies have a relatively small clearance within tube 106. As can fabrication often involves cans of different sizes, tube 106 may be removable so that different diameter tubes may be used. In operation, tube 106 is replaced by first disconnecting chain 118 and removing it from the tube. Thereafter, the channel 120 is disconnected and the induction coil 108 is disconnected from the power source. Next, the hubs supporting the tube 106 within housing 104 are removed, and the tube 106 is slid out from within the coil 108 and apparatus 100. In one embodiment of the invention, the coil 108 is also removed at this point. Next, the new diameter coil and tube are inserted. After the new coil and tube are positioned, the hubs, coil, channel, and chain are reconnected and the apparatus 100 is once again ready for operation. In a preferred embodiment, the tube 106 is selected so as to always provide an approximately one-quarter inch clearance with respect to a can body 102.

As stated above, in a preferred embodiment the coil 108 is replaced when the tube 106 is replaced so that the coil is tightly wound about and substantially concentric with any diameter tube used. In an alternative embodiment of the invention, a single tube and coil may be used for various diameter can bodies and the entire upper surface of conveyor system 124 including channel 120 may be raised or lowered relative to the tube 106 so as to maintain concentricity between the coil 108 and can bodies 102.

Induction coil 108 is provided for uniformly heating can bodies 102. Power source 110 is electrically coupled via wires 152 (FIG. 10) to induction coil 108 and supplies coil 108 with an AC current oscillating at a medium frequency of about 500 Hz to 50 kHz, and optimally about 6 kHz to 18 kHz given the can body wall thickness on the order of about 10 to 15 mils. This oscillating current generates AC eddy currents, also oscillating at the same frequency, around the circumference of can bodies 102 so as to heat the can bodies as they move through the tube 106.

As explained in the Background of the Invention section, high frequency currents tend to concentrate the heat generated within a workpiece near the surface of the workpiece, thus providing a large temperature variation for a relatively small change in separation distance between the workpiece and induction coil. However, according to the present invention, a medium frequency current is used, which current tends to generate currents deeper within the can bodies 102. The deeper currents allow distribution of the generated heat across a larger a cross-sectional area of can bodies 102. Therefore, where the separation distance between the coil 108 and the can body 102 varies, the change in the generated heat will be shared over a greater cross-sectional area of the can body. Sharing the change in heat generation over a larger cross-sectional area reduces the overall temperature change at any point within the cross-sectional area of the can body. In this way, the present invention minimizes temperature changes resulting from undesirable variations in the separation distance between the coil 108 and the can body 102.

Additionally, the medium frequency current carried through the wire leading to and in coil 108 is distributed more evenly through the wire. As such, relatively little heat is generated within coil 108, and coil 108 may be formed with inexpensive standard 8 gauge magnet wire. It is understood, however, that other materials may be used for the induction coil if desired, such as for example multi-filar litz wire.

The coil 108 extends approximately the entire length of heating apparatus 100, and each turn of the coil may be spaced approximately 0.125 to 0.25 inches from the next adjacent turn, thereby yielding 4 to 8 turns per inch. However, it is understood that the spacing between the turns of coil 108 may be more or less than the above disclosed range in alternative embodiments of the invention. For example, it is contemplated that there be no spacing between adjacent turns so that the turns are touching each other. It would be appreciated by those skilled in the art that by using a low frequency current, the coil 108 may be comprised of coil turns having a small diameter, such as that provided by 8 gauge magnet wire or smaller. As such, where there is no spacing between adjacent turns, a large number of turns may be provided per unit length of tube 106, thereby reducing the current required to heat can bodies 102.

In a preferred embodiment of the invention, at 8.5 kHz, power source 110 supplies approximately 3.5 kilowatts to coil 108 resulting in a tank current of approximately 150 to 200 amps RMS. In one embodiment of the invention, the above described current, frequency, turns per inch, spacing between the coil 108 and the can body 102, can body thickness, and heating path length may combine to heat a can body 102 from ambient temperature upon entry into apparatus 100 to approximately 220° C. at the exit of apparatus 100 in approximately 4 seconds.

It is understood that the disclosed values for power, current, frequency, spacing and temperature are merely examples, and each may vary in alternative embodiments of the present invention. Moreover, different protective coatings cure at different temperatures. In a preferred embodiment, the temperature generated within can bodies 102 may be varied by changing the length of an induction heating apparatus 100. Alternatively, more than one induction heating apparatus 100 according to the present invention may be aligned lengthwise adjacent to each other to increase the path length of can bodies 102 through the induction heating process. As would be appreciated by those skilled in the art, other system parameters such as spacing between adjacent turns of coil 108, the output of power supply 110, and/or throughput speed of the can bodies may be varied to also vary the heat generation within can bodies 102.

It may be desirable in some heating applications to apply more heat at a beginning of the heating cycle as compared to the end of the heating cycle. Therefore, in an alternative embodiment of the invention, the turns of the induction coil may be provided more closely together at the front end of the tube 106 than at the rear end of tube 106. Moreover, as would be appreciated by those skilled in the art, turns of coil 108 per unit length may be increased or decreased at any portion along the length of coil 108 to thereby provide greater or lesser heating, respectively, in that portion of the coil.

With the relatively low power requirements for curing the coatings on can bodies 102, a relatively simple airflow cooling system may be employed to prevent induction coil 108 from overheating. As shown in FIG. 3, a blower 114 may be provided on top of the control circuitry 112 to circulate cooling air up and around coil 108. As a large cross-sectional area of the induction coil is used to carry the oscillating current, one blower having a capacity of approximately 300 to 500 cfm and circulating air at ambient temperature is sufficient to cool the entire length of the induction coil. However, as would be appreciated by those skilled in the art, more than one blower 114 may be included along the length of coil 108 and the air flow may be cooled prior to circulation within the chamber 109. Moreover, it is understood that blower 114 may be provided at various locations within the chamber 109 to cool the induction coil 108.

The present invention may further include a closed-loop temperature control for monitoring the temperature of the can bodies 102 as they pass through the tube 106. As shown in FIG. 3, one or more temperature sensors 119 may be provided within tube 106 to sense the temperature of can bodies 102. Sensor 119 may be a conventional temperature sensor such as an infrared (IR) sensor available from Watlow Electric Manufacturing Co., St. Louis, Mo., 63146. Should the temperature of the can bodies 102 be higher than a predetermined temperature, the sensor 119 quickly senses this condition and a signal is sent to the control circuitry 112 to turn off the AC current source. This stops all current flow through the can bodies 102, thereby almost immediately preventing the can bodies 102 from becoming any hotter. Once the temperature sensor 119 senses that the temperature of the can bodies 102 has returned to a predetermined temperature, the sensor 119 may send another signal to control circuitry 12 to once again turn on the AC current source. However, due to the use of medium frequency currents as discussed above, the temperature sensor 119 may be omitted in alternative embodiments of the invention.

Figure 6:
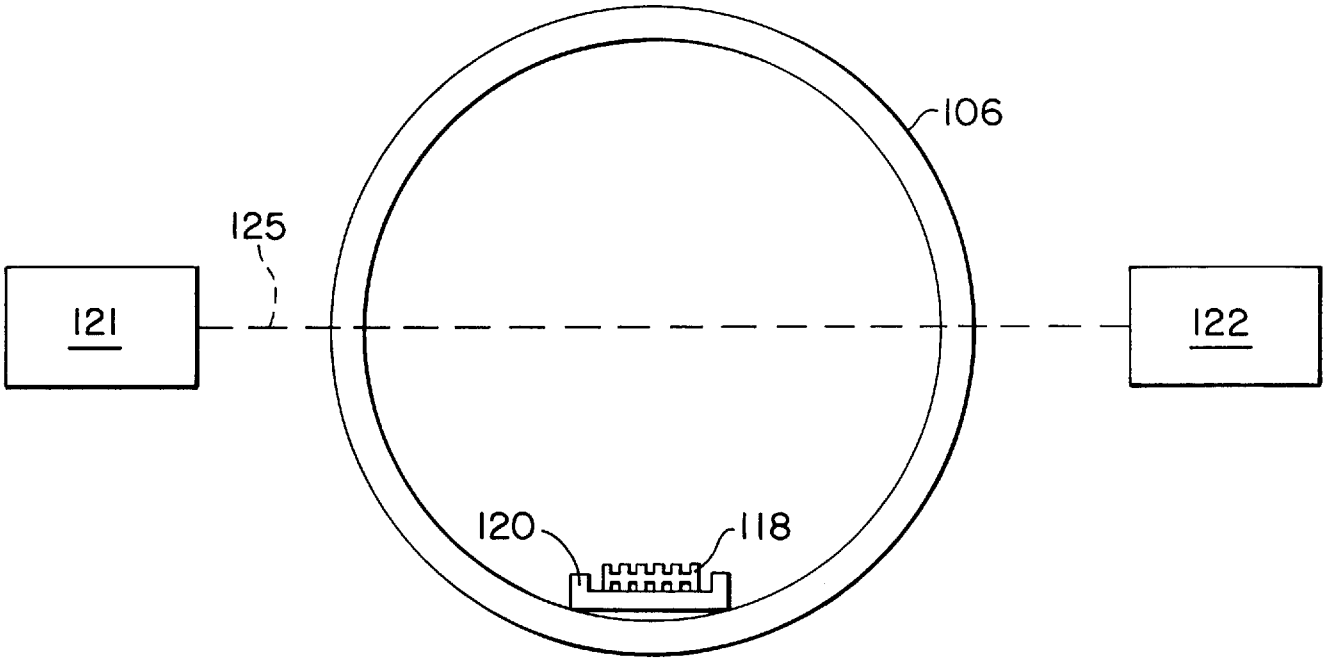
FIG. 6 illustrates a line motion sensor for sensing the presence or absence of a can body along the can throughput path.

Although omitted from FIG. 3 for clarity, the front end 105 or rear end 107 of heating apparatus 100 may include a line motion sensor system comprised of an emitter 121 and a sensor 122 as shown in FIG. 6. Emitter 121 may for example be a conventional light source for emitting a light beam 125, in which case sensor 122 may be a conventional optical sensor. As can bodies enter the heating apparatus 100 (if the sensor system is located on the front end) or as can bodies exit the heating apparatus 100 (if the sensor system is located at the rear end), the can bodies will periodically block transmission of beam 125 to sensor 122. If more than a predetermined period of time passes during which no signal is received in sensor 122, or a constant signal is received in sensor 122, this is an indication that can bodies 102 are not proceeding at the predetermined throughput speed and a jam has developed within the apparatus 100. In this instance, sensor 122 sends a signal to the control circuitry 112 to shut down the power supply to induction coil 108, thereby preventing overheating of the can bodies within the heating apparatus 100. As stated above, shutting down the power supply almost immediately prevents the can bodies 102 from becoming any hotter. Thus, temperature sensor(s) 119 and the line motion sensor system may both be used to prevent overheating of the can bodies within the heating apparatus 100. In addition, the line motion sensor system may be used to determine when the conveyor system has shut down, to thereupon shut off current to the induction coil 108.

Figure 10:
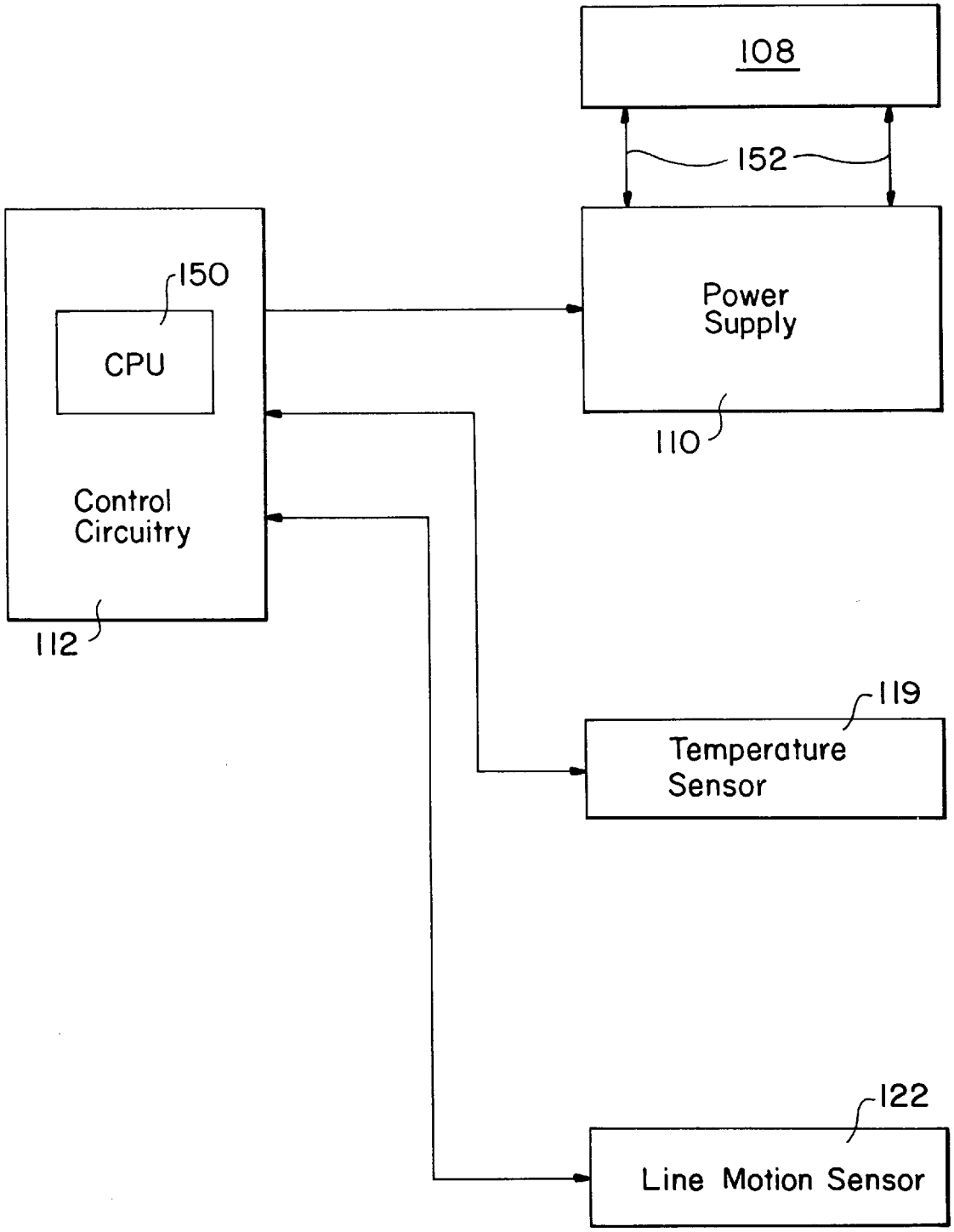
FIG. 10 is a schematic representation of the control circuitry according to the present invention.

The power supply 110 is an alternating current power supply with current outputs that are connected to opposite ends of the coil 108 via wires 152 (FIG. 10). The frequency of current oscillation is essentially the same as the resonant frequency of the coil in combination with tank capacitors (not shown) within the power supply 110, which is on the order of 8 kHz. Other frequencies can also be used if appropriate tank capacitors are used. Preferably, when the power supply 110 is first activated, it automatically but conventionally determines the frequency which optimizes power transfer into the workpiece given the tank capacitance and inductance.

The current output of the power supply 110 should be relatively continuous with low harmonic content. Low harmonic content reduces the skin effect for the lead wires 152 to the tank capacitors and coil, thereby permitting the use of smaller wire leads. Also, the tank capacitors should be as close as possible to the coil 108.

It is desirable that the power supply 110 output be continuously adjustable during activation and de-activation, rather than adjustable merely by a low-frequency duty cycle. This is because duty cycle pulses can cause the can bodies to vibrate and thereby undesirably shake loose some of the protective coating. Activation and de-activation of the power supply 110 may for example be accomplished by gradually increasing and decreasing, respectively, the DC voltage to the power supply 110. General considerations regarding power supplies are disclosed in, for example, Lowdon, "Practical Transformer Design Handbook", 2nd ed. (TAB Books, 1989), incorporated herein by reference.

As shown in FIG. 10, the control circuitry 112 preferably comprises a conventional central processing unit (CPU) 150 for monitoring operation of the power supply 110 and for monitoring temperature and can travel through the apparatus 100 via feedback signals from the temperature sensor 119 and line motion sensor 122, respectively, described above. The control circuitry may further be connected to a conventional input/output device (not shown) to allow screen display of system parameters such as power output, current frequency and can body temperature, and to allow dynamic control and alteration of such system parameters.

Figure 8:
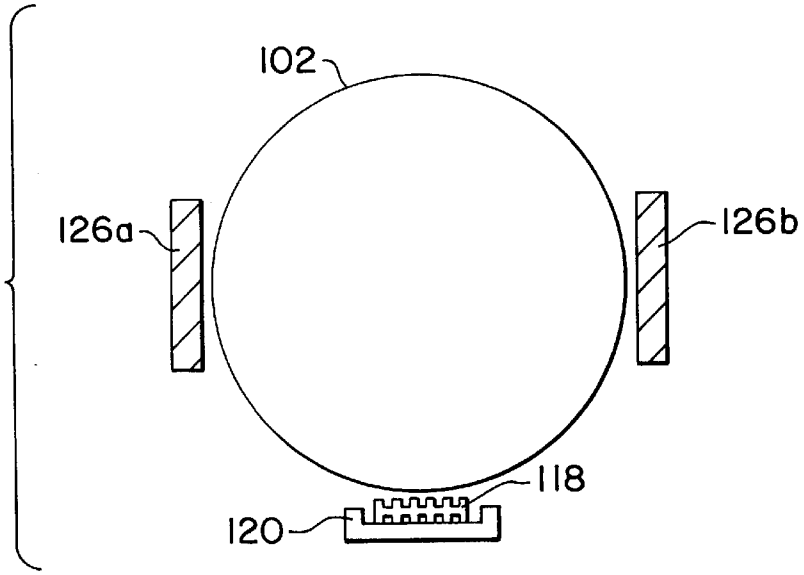
FIG. 8 is a cross-sectional view of a portion of the conveyor system through line 8—8 in FIG. 7.
Figure 9:
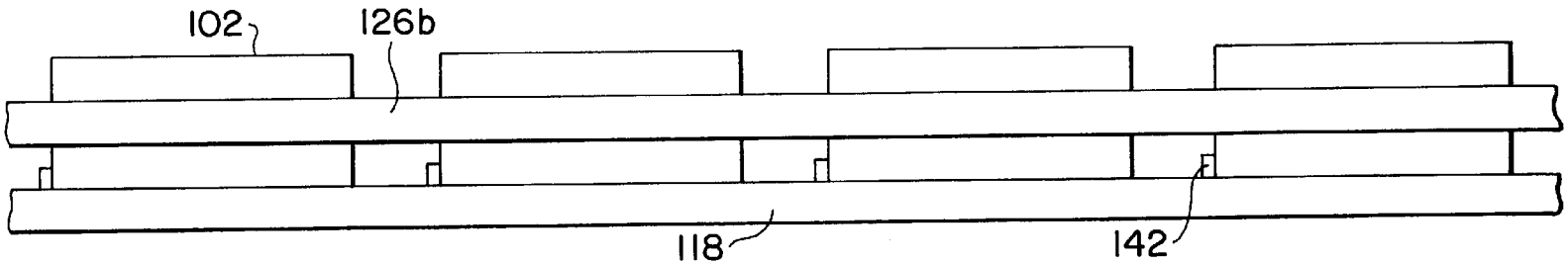
FIG. 9 is a side view of a section of a conveyor system according to the present invention.

Referring now to FIGS. 7 through 9, conveyor system 124 is provided for transporting can bodies 102 from the protective coating process, through the heating apparatus 100, and to the next processing station. Conveyor system 124 includes the endless chain 118, can guides 126*a* and 126*b*, drive wheels 128–134, and tension wheel 136. Chain 118 is preferably a conventional stainless steel 0.125 to 0.25 inch chain having a generally flat upper surface profile. However, it is understood that can bodies 102 may rest on and be transported by any of various conveyor systems such as a linear motor, belt drive, pusher, puller, gravity slide, etc., with the limitation that the conveyor loop must be capable of disconnection and reconnection to allow isolation tube 106 through which the conveyor passes to be changed. In a preferred embodiment, the length of the entire loop of chain 118 is approximately 50 feet.

In a preferred embodiment the entrance to the induction heating apparatus 100 is approximately 3 inches to 3 feet away from the spray coating apparatus, and optimally about 1.5 feet. In operation, can bodies from the spray coating process are transferred in single file to a section 138 of the conveyor system 124 and thereafter conveyed by chain 118 through the heating apparatus. After exiting heating apparatus 100, can bodies 102 are conveyed along a section 140 to the next processing station. A conventional magnetic elevator may be used to transfer can bodies 102 off of chain 118 at the end of the induction heating process. Where can bodies 102 are not magnetically conductive, a mechanism such as a mechanical arm conveyor may be used to transfer the can bodies.

As shown in FIG. 9, chain 118 includes a plurality of hooks 142 which are spaced apart slightly greater than a length of a can body 102. Can bodies are placed on the chain 118 from the spray coating process station and are maintained in a predetermined spacing from each other on chain 118 by means of the hooks 142. In an alternative embodiment, the hooks 142 may be omitted, and the can bodies 102 held in position due to contact with the chain 118. As shown in FIGS. 7 through 9, can bodies are prevented from rolling in a direction perpendicular to the direction of throughput by a pair of can guides 126*a* and 126*b* mounted on either side of the top surface of the conveyor system 124. The can guides 126*a* and 126*b* preferably run along the entire upper surface of the conveyor system 124 except within the heating apparatus 100.

As would be appreciated by those skilled in the art, friction wheels 128–134 may be provided for advancing chain 118 as result of friction or meshed engagement between the chain 118 and the wheels 128–134. One or more of the friction wheels 128–134 may be rotated by a drive motor (not shown) to thereby advance chain 118. As would also be further appreciated by those skilled in the art, conveyor system 124 may further include a tension wheel 136 translationally mounted and biased in a direction away from friction wheels 130 and 132 to maintain tension within the chain 118.

As explained above, in an embodiment including a single tube 106 and coil 108, the chain 118 and channel 120 may be raised or lowered to accommodate different diameter cans in a concentric relationship with coil 108. Therefore, wheels 128 and 130 may be vertically adjustable to raise or lower the height of the chain 118 with respect to the heating apparatus 100. Similarly, the channel 120 is adjustably mounted so that it may be raised or lowered with the chain 118. Any slack in chain 118 may be taken up by translation of wheel 136 as described above.

In a preferred embodiment of the invention, the conveyor system 124 is capable of advancing can bodies 102 at a rate of up to approximately 1350 cans per minute and optimally about 600 cans per minute.

An induction heating system as described above can be used to dry, pre-cure, post-cure or cure coatings around 360° of a can body. Different coatings and line speeds may be accommodated by adjusting the amount of heat generation within can bodies 102 as discussed above. The heating and conveyor system according to the present invention offers several advantages over conventional convection heating systems for curing around 360° of a can body. For example, the disclosed induction heating system is capable of heating can bodies with an 80 to 90% efficiency, as compared to approximately 20% with conventional convection ovens. Moreover, an induction heating apparatus according to the present invention does not require mass handlers or single filers for aligning cans into rows and realigning the cans into single file, respectively. Further still, the induction heating apparatus according to the present invention is extremely compact, occupying fraction of the space of conventional convection heating ovens, and is operationally more cost efficient than conventional convection ovens.

The foregoing description of preferred embodiments of the present invention has been provided for the purposes of illustration and description. It is not intended to be exhaustive or to limit the invention to the precise forms disclosed. Obviously, many modifications and variations will be apparent to practitioners skilled in this art. For example, frequencies which vary within the permitted range are possible. The embodiments were chosen and described in order to best explain the principles of the invention and its practical application, thereby enabling others skilled in the art to understand the invention for various embodiments and with various modifications as are suited to the particular use contemplated. It is intended that the scope of the invention be defined by the following claims and their equivalents.

We claim:

1. A method of at least partially curing a coating onto an electrically conductive cylindrical workpiece by induction heating comprising the steps of:

(a) generating a magnetic field oscillating at a frequency of approximately 500 Hz to 50 kHz along a heating path;

(b) transporting the workpiece through the magnetic field generated in said step (a) along the heating path;

(c) at least partially curing the coating onto the workpiece around a 360°circumference of the workpiece during said step (b) of transporting the workpiece through the magnetic field.

2. A method of at least partially curing a conductive an electrically conductive cylindrical workpiece by induction heating as recited in claim 1 further comprising the step of centering the circumference of the workpiece with respect to the magnetic field during said step (b).

3. A method of at least partially curing a coating onto an electrically conductive cylindrical workpiece by induction heating as recited in claim 2, wherein said step of centering the circumference of the workpiece with respect to the magnetic field comprises the step of physically limiting movement of the workpiece on all sides of the circumference of the workpiece during said step (b).

4. A method of at least partially curing a coating onto an electrically conductive cylindrical workpiece by induction heating as recited in claim 1, said step (a) of generating an oscillating magnetic field comprising the steps of:

(a) providing an induction coil helically along and around the heating path; and (b) generating a current within the induction coil oscillating at a frequency of approximately 500 Hz to 50 kHz.

5. A method of at least partially curing a coating onto an electrically conductive cylindrical workpiece by induction heating as recited in claim 4, further comprising a step (c) of centering the circumference of the workpiece with respect to the magnetic field by supporting the workpiece to be substantially concentric with the induction coil.

6. A method of at least partially curing a coating onto an electrically conductive cylindrical workpiece around a 360° circumference of the workpiece by induction heating as recited in claim 1, further comprising the step of sensing for a discontinuity in a rate of transfer of the workpiece along the heating path.

7. A method of at least partially curing a coating onto an electrically conductive cylindrical workpiece by induction heating as recited in claim 1, further comprising the step of sensing a temperature of the workpiece as the workpiece is transported along the heating path.

8. An apparatus for at least partially curing a coating onto an electrically conductive cylindrical workpiece by induction heating comprising:

a path of travel within the apparatus;

an induction coil circumjacent about said path of travel for heating the workpiece around a 360° circumference of the workpiece;

a current source for generating a current within said induction coil oscillating at a frequency of approximately 500 Hz to 50 kHz so as to generate an oscillating magnetic field within said path of travel;

a conveyor for transporting the workpiece along said path of travel; and a controller for controlling said current source.

9. An apparatus for at least partially curing a coating onto an electrically conductive cylindrical workpiece as recited in claim 8, said controller shutting off said current source if a temperature of the workpiece exceeds a predetermined value while the workpiece is transported along said path of travel.

10. An apparatus for at least partially curing a coating onto an electrically conductive cylindrical workpiece as recited in claim 8, further comprising circulation means for circulating air around said induction coil to prevent said induction coil from overheating.

11. An apparatus for at least partially curing a coating onto an electrically conductive cylindrical workpiece as recited in claim 8, wherein said conveyor comprises an endless belt on which the workpiece rests, said endless belt capable of moving along said path of travel.

12. An apparatus for at least partially curing a coating onto an electrically conductive cylindrical workpiece as recited in claim 11, wherein said belt is comprised of stainless steel.

13. An apparatus for at least partially curing a coating onto an electrically conductive cylindrical workpiece as recited in claim 11, further comprising a channel mounted along said path of travel, said endless belt being located within said channel.

14. An apparatus for at least partially curing a coating onto an electrically conductive cylindrical workpiece as recited in claim 8, wherein said induction coil is wound around said path of travel so as to create a magnetic field that is uniform along said path of travel.

15. An apparatus for at least partially curing a coating onto an electrically conductive cylindrical workpiece as recited in claim 8, wherein said induction coil is wound around said path of travel so as to create a magnetic field that varies along said path of travel.

16. An apparatus for at least partially curing a coating onto an electrically conductive cylindrical workpiece as recited in claim 8, further comprising a cylindrical tube, said conveyor transporting the workpiece along said path of travel through said tube.

17. An apparatus for at least partially curing a coating onto an electrically conductive cylindrical workpiece as recited in claim 16, wherein said inner diameter of said tube is approximately 0.5 inches greater than said outer diameter of the workpiece.

18. An apparatus for at least partially curing a coating onto an electrically conductive cylindrical workpiece as recited in claim 16, further including means for allowing said tube and said induction coil to be removed and replaced by a second tube and a second induction coil having diameters different than said tube and said induction coil to accommodate workpieces of different diameters.

19. An apparatus for at least partially curing a coating onto an electrically conductive cylindrical workpiece as recited in claim 16, wherein said induction coil is helically wound around said tube.

20. An apparatus for at least partially curing a coating onto an electrically conductive cylindrical workpiece as recited in claim 19, further including means for allowing said tube and said non-liquid cooled induction coil to be removed and replaced by a second tube and a second non-liquid cooled induction coil having diameters different than said tube and said non-liquid cooled induction coil to accommodate workpieces of different diameters.

21. An apparatus for at least partially curing a coating onto an electrically conductive cylindrical workpiece around a 360° circumference of the workpiece by induction heating comprising:

a path of travel within the apparatus;

a non-liquid cooled induction coil circumjacent about said path of travel;

a current source for generating a current within said non-liquid cooled induction coil so as to generate an oscillating magnetic field along said path of travel;

a conveyor for transporting the work piece along said path of travel; and a controller for controlling said current source.

22. An apparatus for at least partially curing a coating onto an electrically conductive cylindrical workpiece around a 360° circumference of the workpiece as recited in claim 21, further comprising a rate change sensor for sensing a discontinuity in the rate of transfer of the workpiece along said path of travel.

23. An apparatus for at least partially curing a coating onto an electrically conductive cylindrical workpiece around a 360° circumference of the workpiece as recited in claim 22, wherein said rate change sensor comprises an optical sensor mounted at either end of said path of travel, said optical sensor having a transmitter transmitting an optical signal to a receiver, said optical sensor indicating a discontinuity in the rate of transfer of the workpiece along said path of travel during operation of the apparatus when a predetermined period of time passes during which no signal, or a constant signal, is received in said receiver.

24. An apparatus for at least partially curing a coating onto an electrically conductive cylindrical workpiece around a 360° circumference of the workpiece as recited in claim 21, wherein said conveyor comprises an endless belt on which the workpiece rests, said endless belt moving along said path of travel.

25. An apparatus for at least partially curing a coating onto an electrically conductive cylindrical workpiece around a 360° circumference of the workpiece as recited in claim 21, wherein said induction coil is wound around said path of travel so as to create a magnetic field that is uniform along said path of travel.

26. An apparatus for at least partially curing a coating onto an electrically conductive cylindrical workpiece around a 360° circumference of the workpiece as recited in claim 21, wherein said induction coil is wound around said path of travel so as to create a magnetic field that varies along said path of travel.

27. An apparatus for at least partially curing a coating onto an electrically conductive cylindrical workpiece around a 360° circumference of the workpiece as recited in claim 21, further comprising a cylindrical tube, said conveyor transporting the workpiece along said path of travel through said tube.

28. An apparatus for at least partially curing a coating onto an electrically conductive cylindrical workpiece around a 360° circumference of the workpiece as recited in claim 27, wherein said induction coil is helically wound around said tube.

29. An apparatus for heating a coating on an electrically conductive cylindrical workpiece around a 360° circumference of the workpiece by induction heating comprising:

a housing;

an electrically non-conductive tube supported within said housing and having a first end and a second end;

an induction coil within said housing provided around said tube;

a conveyor for conveying the workpiece through said tube; and a controller operatively connected to said induction coil for controlling operation of said apparatus.

30. An apparatus for heating a coating on an electrically conductive cylindrical workpiece as recited in claim 29, wherein an interior of said tube is sealed off from an interior of said housing.

31. An apparatus for heating a coating on an electrically conductive cylindrical workpiece as recited in claim 29, wherein said conveyor comprises a chain for supporting the workpiece, said chain being an endless chain circulating through said tube.

32. An apparatus for heating a coating on an electrically conductive cylindrical workpiece as recited in claim 31, further comprising a channel provided along a length of said tube for preventing contact between said chain and said tube.

33. An apparatus for heating a coating on an electrically conductive cylindrical workpiece as recited in claim 32, wherein said channel is electrically non-conductive.

34. An apparatus for heating a coating on an electrically conductive cylindrical workpiece as recited in claim 29, wherein said conveyor comprises:

an endless chain circulating through said tube;

a plurality of wheels for supporting and advancing said chain, two wheels of said plurality of wheels defining a surface of said chain on which the workpiece is supported, said surface lying in a plane intersecting said tube; and guides provided on either side of said chain along at least a portion of said surface to maintain the workpiece on said chain.

35. An apparatus for heating a coating on an electrically conductive cylindrical workpiece as recited in claim 34, further comprising a plurality of hooks provided in said chain and spaced apart a distance greater than a lengthwise dimension of the workpiece, a hook of said plurality of hooks capable of engaging the workpiece to prevent relative movement between the workpiece and said chain.

36. An apparatus for heating a coating on an electrically conductive cylindrical workpiece as recited in claim 34, further comprising a tension wheel engaging said chain to maintain tension in said chain.

37. An apparatus for heating a coating on an electrically conductive cylindrical workpiece as recited in claim 29, further comprising means for circulating air through said housing.

38. An apparatus for heating a coating on an electrically conductive cylindrical workpiece as recited in claim 29, further comprising means for circulating air through said tube.

39. An apparatus for heating a coating on an electrically conductive cylindrical workpiece as recited in claim 29, wherein a spacing between turns of said induction coil ranges from approximately 0 to 0.25 inches.

40. An apparatus for heating a coating on an electrically conductive cylindrical workpiece around a 360° circumference of the workpiece by induction heating comprising:

a housing;

a tube supported within said housing and having a first end and a second end;

an induction coil within said housing wound around said tube;

a conveyor for conveying the workpiece through said tube;

a sensor for monitoring the workpiece as it is conveyed through said tube; and a controller for controlling a supply of current to said induction coil in response to preset parameters and in response to feedback signals from said sensor.

41. An apparatus for heating a coating on an electrically conductive cylindrical workpiece as recited in claim 40, wherein said sensor comprises a rate change sensor for sensing a discontinuity in the rate of transfer of the workpiece through said tube.

42. An apparatus for heating a coating on an electrically conductive cylindrical workpiece as recited in claim 41, said controller capable of shutting off supply of current to said induction coil when a feed back signal from said rate change sensor indicates a discontinuity in the rate of transfer of the workpiece through said tube.

43. An apparatus for heating a coating on an electrically conductive cylindrical workpiece as recited in claim 40, wherein said sensor comprises a temperature sensor for sensing a temperature of the workpiece.

44. An apparatus for heating a coating on an electrically conductive cylindrical workpiece as recited in claim 43, said controller capable of shutting off supply of current to said induction coil when a feed back signal from said temperature sensor indicates that a temperature of the workpiece exceeds a predetermined temperature.

45. An apparatus for heating a coating on an electrically conductive cylindrical workpiece as recited in claim 40, further comprising:

first means for circulating air within said housing; and second means for circulating air within said tube;

said controller further controlling said first and second air circulating means.

46. An apparatus for heating a coating on an electrically conductive cylindrical workpiece as recited in claim 40, wherein a spacing between turns of said induction coil ranges from approximately 0 to 0.25 inches.

* * * * *